US007560628B2

(12) United States Patent
Yamao et al.

(10) Patent No.: US 7,560,628 B2
(45) Date of Patent: Jul. 14, 2009

(54) STEEL WIRE AND MANUFACTURING METHOD THEREFOR

(75) Inventors: Norihito Yamao, Nishinomiya (JP); Tatsuji Nagai, Itami (JP); Tetsuo Myo, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 564 days.

(21) Appl. No.: 10/995,345

(22) Filed: Nov. 24, 2004

(65) Prior Publication Data

US 2005/0132867 A1 Jun. 23, 2005

(30) Foreign Application Priority Data

Nov. 28, 2003 (JP) ..... 2003-399534

(51) Int. Cl.
*G10C 3/00* (2006.01)
*G10D 3/10* (2006.01)

(52) U.S. Cl. ..... 84/199; 84/297 S; 84/297 R; 84/455; 428/673

(58) Field of Classification Search ..... 84/297 S, 84/297 R, 455, 199; 428/673
See application file for complete search history.

(56) References Cited

U.S. PATENT DOCUMENTS

| | | | | | |
|---|---|---|---|---|---|
| 8,452 | A * | 10/1851 | Newton | 428/673 |
| 1,383,174 | A * | 6/1921 | Udy et al. | 428/657 |
| 3,432,971 | A * | 3/1969 | Conti | 451/194 |
| 3,598,658 | A * | 8/1971 | Matsukura et al. | 148/546 |
| 3,617,230 | A * | 11/1971 | Richards et al. | 428/606 |
| 3,702,489 | A * | 11/1972 | Nakamura et al. | 15/88 |
| 4,525,598 | A * | 6/1985 | Tsukamoto et al. | 174/128.1 |
| 4,545,227 | A * | 10/1985 | Sudoh et al. | 72/17.3 |
| 4,737,392 | A * | 4/1988 | Dambre | 428/35.8 |
| 4,777,337 | A * | 10/1988 | Inoue | 219/69.2 |
| 5,186,768 | A * | 2/1993 | Nomoto et al. | 148/580 |
| 5,213,632 | A * | 5/1993 | Peeters et al. | 148/320 |
| 5,439,713 | A * | 8/1995 | Yamaoka et al. | 427/433 |
| 5,693,899 | A * | 12/1997 | Kalosdian | 84/297 S |
| 5,776,267 | A * | 7/1998 | Nanba et al. | 148/328 |
| 5,907,113 | A * | 5/1999 | Hebestreit et al. | 84/297 R |
| 5,919,415 | A * | 7/1999 | Pichard | 420/106 |
| 5,953,944 | A * | 9/1999 | Groening et al. | 72/40 |
| 5,956,935 | A * | 9/1999 | Katayama et al. | 57/212 |
| 6,074,496 | A * | 6/2000 | Yarita et al. | 148/333 |
| 6,216,507 | B1 * | 4/2001 | Groening et al. | 72/40 |
| 6,328,820 | B1 * | 12/2001 | Yamamoto et al. | 148/320 |
| 6,372,056 | B1 * | 4/2002 | Kuroda et al. | 148/320 |
| 6,800,147 | B2 * | 10/2004 | Nagao et al. | 148/320 |
| 7,074,282 | B2 * | 7/2006 | Ibaraki et al. | 148/333 |
| 2005/0132867 | A1 * | 6/2005 | Yamao et al. | 84/452 R |
| 2009/0020189 | A1 * | 1/2009 | Yoshihara et al. | 148/506 |

FOREIGN PATENT DOCUMENTS

| | | |
|---|---|---|
| JP | 53-095613 | 8/1978 |
| JP | 53-095616 | 8/1978 |
| JP | 58-120735 | 7/1983 |
| JP | 59-24517 | 2/1984 |
| JP | 63-002524 | 1/1988 |
| JP | HEI 10-105155 | 4/1998 |
| WO | WO 01/27339 A1 | 4/2001 |
| WO | WO 2004/067789 A1 | 8/2004 |

OTHER PUBLICATIONS

Article downloaded from Internet entitled "Product Standards, Wire Rod". Writer: anonymous.
Article downloaded from the Internet entitled "Methods of Measuring Decarburized Depth for Steel". Writer: anonymous.
European Search Report dated Jul. 12, 2005.

* cited by examiner

*Primary Examiner*—Lincoln Donovan
*Assistant Examiner*—Robert W Horn
(74) *Attorney, Agent, or Firm*—Dickstein Shapiro LLP

(57) ABSTRACT

A steel wire (e.g., a piano wire) for use in a stringed musical instrument is designed to have a specific chemical composition in which phosphorus content ranges from 0.015 weight percent to 0.050 weight percent, wherein the total decarburized layer depth of a decarburized layer formed on the surface, which is subjected to decarburized depth measurement using a microscope method as defined in the Japanese Industrial Standard JIS G 0588, is reduced to 2 μm or less. Other chemical substances included in the chemical composition of the steel wire are preferably defined in the standard JIS G 3502 regarding chemical compositions of piano wires. In manufacturing, a rolled steel material is subjected to wire drawing and patenting under prescribed conditions, wherein the sound quality realized by the steel wire installed in a stringed musical instrument can be noticeably improved by adopting both chemical composition control and total decarburized layer depth control.

3 Claims, No Drawings

STEEL WIRE AND MANUFACTURING METHOD THEREFOR

BACKGROUND OF THE INVENTION

1. Field of the Invention

This invention relates to steel wires for use in stringed instruments, such as piano wires of pianos, and to manufacturing methods therefor.

This application claims priority on Japanese Patent Application No. 2003-399534, the content of which is incorporated herein by reference.

2. Description of the Related Art

Conventionally, steel wires such as piano wires defined in the Japanese Industrial Standard, that is, JIS G 3522, which are manufactured using piano wire materials (or rolled wire materials) defined in JIS G 3502, are used for so-called music wires or steel wires for use in stringed instruments such as pianos.

According to Japanese Patent Application Publication No. S53-95616, it is necessary to provide music wires (or strings) of stringed instruments with a relatively high tensile strength and a relatively high elasticity, which significantly influences the sound quality of stringed instruments. It is also required that music wires have overall characteristics in which their sectional areas have uniform and true circular shapes, and they are resistant to corrosion.

Even though music wires are developed in consideration of the aforementioned characteristics, the sound quality realized by the conventional music wires is imperfect, and therefore various attempts have been made to further improve music wires in terms of the sound quality of stringed musical instruments.

For example, Japanese Patent Application Publication No. S63-2524 discloses a technology regarding the straightening process using straightening rolls after die drawing. Japanese Patent Application Publication No. H10-105155 discloses the technology regarding the plating on surfaces of steel wires so as to demonstrate anti-corrosion effects. In addition, various documents disclose methods for further improving musical instruments in sound quality by using steel wires while maintaining satisfactory performance substantially equivalent to that of conventional musical instruments. For example, Japanese Patent Application Publication No. S53-95616 discloses that prescribed portions of strings struck by hammers are made different in sectional areas compared with other portions of strings. Japanese Patent Application Publication No. S53-95613 discloses the technology for partially changing the winding density of lines wound about wire cores (or music wires).

As described above, various improvements have been made with respect to music wires. However, due to a strong demand for producing superior sound quality, it is required to produce further improved music wires to cope with demands for further improvements in the sound quality of musical instruments.

SUMMARY OF THE INVENTION

It is an object of the invention to provide steel wires for use in stringed instruments, which are improved in sound quality.

It is another object of the invention to provide a manufacturing method for steel wires for use in stringed musical instruments.

This invention achieves the aforementioned objects by adopting at least one of two measures, i.e., adequate determination of chemical composition of steel wires and adequate control of decarburized layers, in manufacturing steel wires (or music wires) for use in musical instruments.

In a first aspect of the invention, steel wires each contain a prescribed weight percent of the phosphorus content ranging from 0.015% to 0.050%. Generally speaking, phosphorus dominantly exists in the crystal grain boundary of steel wires. It is considered that phosphorus may reduce toughness of materials and processability of rolled wires. For this reason, the Japanese Industrial Standard JIS G 305 regarding piano wires defines that the weight percent of the phosphorus content should be 0.025% or less. Manufacturers make every effort to reduce the phosphorus content in piano wires, which are actually sold on the market, to be as low as possible; therefore, the phosphorus content is reduced to 0.015% or so, which is lower than the aforementioned upper-limit value of 0.025% defined in the aforementioned standard.

We, the inventors, have made various experiments on the phosphorus content in consideration of the influence of the phosphorus, which exists in the grain boundary of steel wires and which may badly affect damping characteristics of sound waves propagating through steel wires. As a result, we found that steel wires having the superior sound quality, which is superior to that of the sound quality of conventionally known steel wires, can be produced by regulating the weight percent of the phosphorus content in a range between 0.015% and 0.050%, preferably, in a range between 0.015% and 0.025%.

It is preferable to adopt the other chemical composition as defined in the Japanese Industrial Standard JIS G 3502 regarding piano wires except for phosphorus contained in steel wires, wherein steel wires preferably contain various chemical substances, i.e., C (i.e., carbon whose weight percent ranges from 0.6% to 0.95%), Si (i.e., silicon whose weight percent ranges from 0.12% to 0.32%), Mn (i.e., manganese whose weight percent ranges from 0.30% to 0.90%), S (i.e., sulfur whose weight percent is 0.025% or less), and Cu (i.e., copper whose weight percent is 0.20% or less). It is preferable to determine the chemical composition including phosphorus (P) and the aforementioned substances as well as Fe and irreversible impurities. Specifically, it is preferable to use the so-called steel types SWRS82A and SWRS83A defined in the aforementioned standard.

Normally, the aforementioned steel wires are produced in a series of steps, i.e., rolling, patenting, and wire drawing, wherein the wire drawing and patenting can be performed repeatedly. Herein, it is preferable that the wire drawing be performed under temperature control in which the wire temperature does not increase to be higher than 150° C. just after the wire drawing. As the phosphorus content increases, the processability of steel wire decreases. Therefore, it is possible to guarantee the satisfactory processability in performing the wire drawing, and the satisfactory toughness of steel wires actually used in pianos by controlling the temperatures of the wires, which tend to increase due to heating in wire drawing, specifically, by controlling the surface temperatures of wires just after they pass through wire drawing dies. The aforementioned wire temperature control can be actualized by directly subjecting wires to water cooling during the wire drawing.

In a second aspect of the invention, steel wires have decarburized layers whose total depth measured by the so-called decarburized depth measurement using the microscope method, which is defined in the Japanese Industrial Standard JIS G 0558, is 2 μm or less. It is preferable that substantially no decarburized layers can be observable in the steel wires.

We, the inventors, paid a great deal of attention to decarburized layers which irreversibly exist on the surfaces of conventionally known wires, wherein we found that the sound quality can be improved by controlling the thickness of decarburized layers. That is, music wires are produced using rolled wire materials defined by the standard JIS G 3502 and are repeatedly subjected to thermal treatment including wire drawing and patenting, whereby it is possible to produce music wires having satisfactory toughness and the prescribed diameter. That is, hot rolling is normally performed in the atmosphere under the prescribed temperature of 1000° C. or so, wherein decarburized layers having a relatively low carbon concentration are irreversibly formed on the surfaces of rolled wire materials in the certain thickness approximately ranging from 50 μm to 100 μm. The decarburized layers do not vanish during other steps such as patenting and wire drawing; therefore, they remain on the surfaces of the steel wires, which are end products, at a certain thickness or depth of approximately 5 μm. Steel wires contain carbon grains that mainly exist in the cementite portion of the metal structure, in which ferrite containing substantially no carbon and cementite (i.e., $Fe_3C$, which is a compound of carbon and iron) alternately exist in a layered manner. We found that decarburized layers have a small amount of cementite and differ from other non-carbon portions existing in the same sectional area in terms of damping characteristics of sound waves, thus badly affecting the sound quality. It can be said that the sound quality improvement becomes low when the total decarburized layer depth exceeds 2 μm.

The manufacturing method for the aforementioned steel wires comprises a first step for performing wire drawing and patenting on rolled wire materials, and a second step for removing decarburized layers existing on the surfaces of the rolled wire materials. Since the steel wires are produced in a series of steps, namely, rolling, patenting, and wire drawing, decarburized layers can be removed in any step after rolling. In addition, it is possible to repeatedly perform wire drawing and patenting. Decarburized layers are not necessarily removed by use of a specific device or equipment, wherein it is preferable to remove them by peeling, which can be easily actualized using peeling dies.

One of the aforementioned limitation of the phosphorus content and the removal of decarburized layers may solely contribute to the improvement of the sound quality. Of course, it is possible to realize the further improvement of the sound quality by combining them.

As described above, this invention guarantees the realization of the superior sound quality by the steel wires used in stringed instruments by adopting at least one of the following two measures.

(1) To limit the phosphorus content in a steel wire within a prescribed range of weight percent.
(2) To reduce the total decarburized layer depth within a prescribed range of dimensions.

Thus, this invention can offer steel wires that can be produced using a simple method so as to realize the high sound quality in stringed instrument.

DESCRIPTION OF THE PREFERRED EMBODIMENTS

This invention will be described in further detail by way of examples with reference to the accompanying drawings.

Rolled wire materials having chemical compositions shown in Table 1 (defining weight percents of prescribed chemical substances with respect to various samples) are used as supplied materials, wherein "comparative steel 1 (i.e., Steel 1)" corresponds to the piano wire material SWRS82A defined in the standard JIS G 3520. In Table 1, both of "Example 1" and "Example 2" are embraced within the Japanese Industrial Standard (JIS) in terms of the phosphorus content, wherein Example 1 is increased in the phosphorus content to 0.017 weight percent, and Example 2 is increased to 0.022 weight percent. In addition, "Example 3" is further increased in the phosphorus content beyond the range defined in JIS to 0.046 weigh percent. Furthermore, "comparative steel 2 (i.e., Steel 2)" is further increased in the phosphorus content to 0.058 weight percent. Other chemical substances (other than phosphorus) are defined in contents in accordance with the chemical composition of the piano wire material SWRS82A, wherein each of the supplied materials shown in Table 1 roughly contains the same amounts of the other chemical substances as well as Fe as the remainder thereof.

TABLE 1

| | C | Si | Mn | P | S | Cu |
|---|---|---|---|---|---|---|
| SWRS 82A | 0.80-0.85 | 0.12-0.32 | 0.30-0.60 | 0.025 or less | 0.025 or less | 0.20 or less |
| Steel 1 | 0.81 | 0.22 | 0.45 | 0.012 | 0.011 | 0.02 |
| Example 1 | 0.82 | 0.20 | 0.47 | 0.017 | 0.012 | 0.03 |
| Example 2 | 0.81 | 0.18 | 0.46 | 0.022 | 0.011 | 0.03 |
| Example 3 | 0.82 | 0.21 | 0.47 | 0.046 | 0.013 | 0.02 |
| Steel 2 | 0.83 | 0.20 | 0.46 | 0.055 | 0.012 | 0.02 |

Steel wires having a diameter of 1.0 mm are produced using the aforementioned rolled wire materials in accordance with the following steps.

(a) Providing rolled wire material (whose diameter is 8.0 mm).
(b) Wire drawing performed using one sheet of die, thus actualizing the diameter of 7.2 mm after wire drawing.
(c) Peeling as necessary.
(d) Patenting performed at the heating temperature of 900° C. and at the isothermal transformation temperature of 550° C.
(e) Wire drawing performed using seven sheets of dies, thus actualizing the diameter of 3.3 mm after wire drawing.
(f) Patenting performed at the heating temperature of 900° C. and at the isothermal transformation temperature of 550° C.
(g) Wire drawing performed using ten sheets of dies, thus actualizing the diameter of 1.0 mm after wire drawing.

In the above, the wire drawing is actualized by directly subjecting the wire materials to water cooling so that the wire temperature just after the wire drawing is controlled not to exceed 150° C. In addition, the peeling is performed as necessary with respect to the selected samples as shown in Table 2, wherein the peeling value (i.e., the depth of the surface being removed by peeling) is set to 70 μm or 100 μm in one side, that is, the peeling diameter is set to 140 μm or 200 μm. Herein, the total decarburized layer depth is measured by the microscope method as defined in JIS G 0558, in which the term "decarburized layer" is defined as the prescribed portion of a steel whose surface is reduced in carbon concentration due to hot working or heat treatment applied thereto, and the term "total decarburized layer depth" is defined as the distance measured between the surface of a decarburized layer and a specific position at which substantially no chemical or physical property is observable between the decarburized layer and its substrate. This standard also defines the following three steps of the decarburized depth measurement using the microscope method.

(a) Polishing is performed with respect to the plane that is cut perpendicular to the surface of a tested material, thus forming a measured surface, wherein it is necessary to pay a great attention such that in cutting or polishing, ends of the measured surface will not be rounded.

(b) The measured surface is subjected to corrosion using an appropriate corrosion method depending upon the type of a steel being tested, wherein a microscope is used to measure area ratios regarding ferrite, pearlite, and carbide, thus detecting the decarburized state and estimating the total decarburized layer depth.

(c) In the above, the magnification factor ranges from '100' to '500', wherein the total decarburized layer depth is measured using eyeglasses having reading scales.

Table 2 shows on/off of peeling, peeling values, and total decarburized layer depth with regard to twelve samples in total.

TABLE 2

| Samples | Supplied rolled steel material | Peeling ON/OFF | Peeling Value | Total Decarburized Layer Depth |
|---|---|---|---|---|
| Comparative Example 1 | Steel 1 | OFF | — | 5.0 μm |
| Embodiment 1 | Steel 1 | ON | 70 μm | 2.0 μm |
| Embodiment 2 | Steel 1 | ON | 100 μm | None |
| Embodiment 3 | Example 1 | OFF | — | 4.5 μm |
| Embodiment 4 | Example 1 | ON | 70 μm | 1.5 μm |
| Embodiment 5 | Example 1 | ON | 100 μm | None |
| Embodiment 6 | Example 2 | OFF | — | 5.0 μm |
| Embodiment 7 | Example 2 | ON | 70 μm | 2.0 μm |
| Embodiment 8 | Example 2 | ON | 100 μm | None |
| Embodiment 9 | Example 3 | OFF | — | 4.5 μm |
| Embodiment 10 | Example 3 | ON | 100 μm | None |
| Comparative Example 2 | Steel 2 | OFF | — | 4.5 μm |

The aforementioned twelve samples are actually installed in pianos, which are played in front of fifty listeners to judge the sound quality (or tone color) of these samples in comparison with Comparative Example 1, wherein the assessment is performed by counting the number of listeners 'A' who feel that the designated sample is superior in sound quality than Comparative Example 1, and the number of listeners 'B' who feel that the designated sample is inferior in sound quality than Comparative Example 1.

Table 3 shows the assessment result in which all of the embodiments 1-10 actualize noticeable improvements of the sound quality, wherein the number of listeners 'A' who feel that they are superior in sound quality to Comparative Example 1 is greater than the number of listeners 'B' who feel that they are inferior in sound quality to Comparative Example 2 by ten or more persons.

TABLE 3

| Samples | A | B | A – B |
|---|---|---|---|
| Comparative Example 1 | — | — | — |
| Embodiment 1 | 14 | 2 | 12 |
| Embodiment 2 | 27 | 0 | 27 |
| Embodiment 3 | 24 | 0 | 24 |
| Embodiment 4 | 42 | 0 | 42 |
| Embodiment 5 | 50 | 0 | 50 |
| Embodiment 6 | 28 | 0 | 28 |
| Embodiment 7 | 44 | 0 | 44 |
| Embodiment 8 | 50 | 0 | 50 |
| Embodiment 9 | 16 | 1 | 15 |
| Embodiment 10 | 41 | 0 | 41 |
| Comparative Example 2 | 5 | 4 | 1 |

As to the phosphorus content, Table 3 clearly shows that the samples of this invention, in which the phosphorus content ranges from 0.015 weight percent to 0.050 weight percent, offer improvements in sound quality by comparing Comparative Example 1 and Comparative Example 2 with Embodiment 3, Embodiment 6, and Embodiment 9. In particular, the prescribed samples, in which the phosphorus content ranges from 0.015 weight percent to 0.025 weight percent, offer noticeable improvements in sound quality because the number of listeners 'A' who feel that they are superior in sound quality to Comparative Example 1 exceeds twenty.

As to the total decarburized layer depth, it can be said through the comparison between Comparative Example 1 and Embodiments 1-2 and the comparison between Comparative Example 1 and Embodiments 3, 4, and 5 that a relatively large number of listeners feel that the prescribed samples, in which the total decarburized layer depth is reduced to 2 μm or less by performing 70 μm peeling, are superior in sound quality to the other samples in which peeling is not performed. In particular, a great number of listeners feel that the samples, in which 100 μm peeling is performed so that substantially no decarburized layer is recognized, offer good sound quality.

As to Embodiments 4, 5, 7, 8, and 10 in which both of the phosphorus content control and the total decarburized layer depth control are performed, forty or more listeners feel that they offer good sound quality. That is, it can be said that the sound quality can be effectively improved by adopting both of the aforementioned measures. In particular, all of the fifty listeners feel that Embodiments 5 and 8, in which the phosphorus content is controlled within a range between 0.015 weight percent and 0.025 weigh percent so that substantially no decarburized layer is observed, offer good sound quality. That is, it can be said that the sound quality can be improved most effectively by combining the phosphorus content control within the aforementioned range and the total decarburized layer depth control.

Lastly, it is emphasized that steel wires as defined in this invention can be preferably applied to stringed musical instruments such as pianos.

As this invention may be embodied in several forms without departing from the spirit or essential characteristics thereof, the aforementioned embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A manufacturing method for a steel wire for use in a stringed musical instrument, comprising the steps of:

subjecting a rolled wire material to wire drawing and patenting;

removing decarburized layers existing on a surface of the rolled wire material affects damping characteristics of the sound waves propagating though the steel wire until a depth of the decarburized layers is 2 μm or less; and thereafter processing the steel wire further to produce musical instrument strings.

2. The manufacturing method for a steel wire for use in a stringed musical instrument according to claim 1, wherein the phosphorus content of the rolled wire material ranges from 0.015 weight percent to 0.050 weight percent.

3. The manufacturing method of claim 1, wherein the step of removing decarburized layers comprises the step of peeling using peeling dies.

* * * * *

US007560628C1

(12) INTER PARTES REEXAMINATION CERTIFICATE (931st)

United States Patent

Yamao et al.

(10) Number: US 7,560,628 C1

(45) Certificate Issued: Aug. 8, 2014

(54) STEEL WIRE AND MANUFACTURING METHOD THEREFOR

(75) Inventors: Norihito Yamao, Nishinomiya (JP); Tatsuji Nagai, Itami (JP); Tetsuo Myo, Hamamatsu (JP)

(73) Assignee: Yamaha Corporation, Nakazawa-Cho, Naka-Ku, Hamamatsu-Shi, Shizuoka-Ken (JP)

Reexamination Request:
No. 95/001,626, Jul. 1, 2011

Reexamination Certificate for:

| | |
|---|---|
| Patent No.: | **7,560,628** |
| Issued: | **Jul. 14, 2009** |
| Appl. No.: | **10/995,345** |
| Filed: | **Nov. 24, 2004** |

(30) Foreign Application Priority Data

Nov. 28, 2003 (JP) ..... 2003399534

(51) Int. Cl.
*G10C 3/00* (2006.01)
*G10D 3/10* (2006.01)

(52) U.S. Cl.
USPC ..... 84/199; 428/673; 84/297 R; 84/297 S; 84/455

(58) Field of Classification Search
None
See application file for complete search history.

(56) References Cited

To view the complete listing of prior art documents cited during the proceeding for Reexamination Control Number 95/001,626, please refer to the USPTO's public Patent Application Information Retrieval (PAIR) system under the Display References tab.

*Primary Examiner* — Margaret Rubin

(57) ABSTRACT

A steel wire (e.g., a piano wire) for use in a stringed musical instrument is designed to have a specific chemical composition in which phosphorus content ranges from 0.015 weight percent to 0.050 weight percent, wherein the total decarburized layer depth of a decarburized layer formed on the surface, which is subjected to decarburized depth measurement using a microscope method as defined in the Japanese Industrial Standard JIS G 0588, is reduced to 2 μm or less. Other chemical substances included in the chemical composition of the steel wire are preferably defined in the standard JIS G 3502 regarding chemical compositions of piano wires. In manufacturing, a rolled steel material is subjected to wire drawing and patenting under prescribed conditions, wherein the sound quality realized by the steel wire installed in a stringed musical instrument can be noticeably improved by adopting both chemical composition control and total decarburized layer depth control.

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-3 are cancelled.

* * * * *